United States Patent [19]

Cholet et al.

[11] Patent Number: 4,886,131

[45] Date of Patent: Dec. 12, 1989

[54] INCLINED-JET DRILLING TOOL

[75] Inventors: Henri Cholet, Le Pecq; Christian Bardin, Bois Colombes, both of France

[73] Assignee: Institut Francais du Petrole, Rueil Malmaison, France

[21] Appl. No.: 257,308

[22] PCT Filed: Dec. 30, 1987

[86] PCT No.: PCT/FR87/00522

§ 371 Date: Aug. 31, 1988

§ 102(e) Date: Aug. 31, 1988

[87] PCT Pub. No.: WO88/05107

PCT Pub. Date: Jul. 14, 1988

[30] Foreign Application Priority Data

Dec. 31, 1986 [FR] France ..... 86 18415

[51] Int. Cl.[4] ..... E21B 10/18

[52] U.S. Cl. ..... 175/340; 175/393; 175/424

[58] Field of Search ..... 175/339, 340, 393, 424, 175/67

[56] References Cited

U.S. PATENT DOCUMENTS 4,106,577 8/1978 Summers ..... 175/340
4,239,087 12/1980 Castel et al. ..... 175/340
4,784,231 11/1988 Higgins ..... 175/340

FOREIGN PATENT DOCUMENTS 2378938 8/1978 France .
2421270 10/1979 France .
2421271 10/1979 France .
1046466 10/1983 U.S.S.R. ..... 175/339
2072243 3/1980 United Kingdom ..... 175/340

*Primary Examiner*—Stephen J. Novosad
*Assistant Examiner*—Terry Lee Melius
*Attorney, Agent, or Firm*—Antonelli, Terry & Wands

[57] ABSTRACT

A drilling tool including cutting teeth carried by rollers or conically-shaped wheels, with an irrigation arrangement being provided for delivering at least one irrigation fluid jet through a calibrated orifice. A center of the fluid jet at an outlet of the orifice is disposed at a distance from a plane perpendicular to an axis of the tool passing through an apex of the teeth of the drilling tool as viewed from a working face of the drilling tool. A magnitude of the tool diameter, height of the teeth, and distance are determined in accordance with the following relationships:

$$d > 1.8\ H \text{ and}$$

$$0.125D < d < 0.185\ D$$

where:

d = a distance between a center of the outlet orifice of a plane perpidencular to the tool axis and passing through tips of the teeth nearest to the working face of the drilling tool;

H = a height of the teeth of the drilling tool; and

D = a diameter of the drilling tool.

17 Claims, 4 Drawing Sheets

INCLINED-JET DRILLING TOOL

BACKGROUND OF THE INVENTION

The present invention relates to a drilling tool and, more particularly but not limitatively, to a drilling tool or bit attachable to a lower end of a drilling string, with the tool having several revolving parts fitted with cutting elements, whereby these elements may be conical wheels revolving on bearings whose axes are inclined with respect to the central axis of the tool.

In the past, the performance of such tools, used for drilling into the ground, has been improved by the simultaneous action of jets of drilling fluid which strike the bottom of the hole or working face, in each of the free spaces between the elements cutting the ground. At the tool level, the essential purpose of this drilling fluid is to cool the tool, clean the tool and working face, and rapidly evacuate the cuttings to the annular space between the drilling string and the wall of the drilled hole.

In a first type of tool according to the prior art, the jets of fluid emerge at a point well above the cutting level of the wheels. As a result, before reaching the working face, the jets pass through the cutting-laden drilling fluid which fills the bottom of the drilled hole. For this reason, the flowrate of the jets at the level of the working face is considerably slowed down, which reduces their efficiency. Moreover, the jets sweep some of the cutting-laden drilling fluod to the working face where the cuttings are re-ground by the tool whose efficiency is thus decreased. Moreover, the jets of fluid create an overpressure at the working face which compresses the rock, and it has been found that the contact zone between the tool and the working face where the cuttings are produced is insufficiently irrigated by the drilling fluid.

Various modifications have been proposed and, in particular, tools of the type indicated above have been modified so that the jets of drilling fluid emerge as close as possible to the working face and sometimes even an axial jet has been added. However, these improvements have not given full satisfaction since a re-grinding of the cuttings could not be eliminated, nor could the overpressure at the working face.

In a second type of tool according to the prior art, it has been proposed to use, in combination with the irrigation means comprising fluid jets, means 4 aspirating the cutting-laden fluid, which means comprises a jet directed in the direction opposite the tool advance direction.

Tools of the aforementioned type are disclosed in, for example, French Patents 2,378,938, 2,421,270, and 2,421,271.

The present invention proposes a tool of the first type defined above which by design is simple and rugged in construction while having a markedly enhanced application performance by comparison with tools of the same type, approaching that of tools of the second type while not having aspiration jets.

In accordance with advantageous features of the present invention, a ground drilling tool is provided having a tool body rotationally driven by a tool holder, with a cavity being provided in the tool body for receiving a pressurized fluid through the tool holder. A plurality of revolving parts in the form of rollers or conical wheels are provided and are carried by the tool body, with the revolving parts being provided with teeth along a working face thereof for biting into the ground.

Irrigation means deliver at least one jet of irrigation fluid directed toward the working face, with the irrigation means comprising at least a first calibrated orifice in the tool body, communicating with the cavity of the tool body and opening into a space between two adjacent revolving parts. The calibrated orifice produces a jet of fluid directed at one of the two revolving parts between which the first space is defined, with the center of the jet of fluid at the outlet of the orifice being located at a distance from a plane P perpendicular to the tool axis passing through the tips of the teeth as viewed from the working face. The magnitudes of the tool diameter, height of the teeth, and distance of the outlet are determined in accordance with the following relationship:

$$d > 1.8H \text{ and}$$

$$0.125D < d < 0.185D,$$

where:

d = a distance of the outlet from a plane P perpendicular to the tool axis;

H = a height of the teeth; and

D = a diameter of the tool.

When the tool according to the invention has irrigation means which comprise an extension containing the calibrated orifice, the extension being at a minimum distance t from the plane P, then the magnitudes D, H, and t having the following relationship:

$$t > 1.5H \text{ and}$$

$$0.1D < t < 0.15D.$$

The irrigation means may comprise at least two calibrated orifices for producing jets of fluid directed at the two revolving parts between which the first space is defined.

The irrigation means may have at least one flow nozzle or irrigation nozzle containing the calibrated orifice or orifices.

The jet of fluid produced by the orifice may have an orientation essentially tangential to the outer surface of the revolving parts.

The revolving parts may have essentially a conical shape, and the orifice may be composed of elongated slots whose elongation direction may be essentially parallel to a generatrix of a revolving part.

The tool according to the invention may have three revolving parts defining three spaces between two adjacent revolving parts, of which only two spaces may be equipped with calibrated orifices, with only one of these spaces having no fluid injection orifice.

The axis of the jet produced by the orifice, when the latter is supported by a nozzle, may make an angle of between 15° and 45° with plane P, and preferably an angle equal to 30°.

When the injection orifice is slot-shaped, two of the walls defining the internal shape of this slot may lie in two planes making an angle of 15° between them.

According to one version of the present invention, the tool may have two calibrated orifices located on either side of a plane essentially parallel to the tool axis, essentially containing the axis of rotation of a revolving part. These orifices may produce one jet each, one oriented toward the revolving part and the other directed at the working face. Moreover, these orifices may produce jets offset with respect to each other.

The tool may have two other calibrated orifices, with the orifices producing one jet directed toward the working face and one toward one of the other revolving parts, respectively.

Each of the jets produced by the other orifices may be oriented essentially at 60° with respect to the median axis defined by the two revolving parts closest to the orifice.

One of the offset jets may make an angle of approximately 30° with the median axis defined by the two revolving parts closest to this orifice.

The other offset jet may subtend an angle λ which is approximately determined in accordance with the following relationship:

$$\tan \eta = \frac{\sqrt{3}}{1 - \frac{4e}{D}}$$

where:

D=the diameter of the tool; and e=a distance separating a center of a calibrated orifice from a circumference of the tool.

The tool according to the present invention is particularly suitable for drilling soft, sticky ground.

The above and other objects, features, and advantages of the present invention will become more apparent from the following description when taken in connection with the accompanying drawings, which show, for the purposes of illustration only, several embodiments in accordance with the present invention.

DETAILED DESCRIPTION

Figure 1:
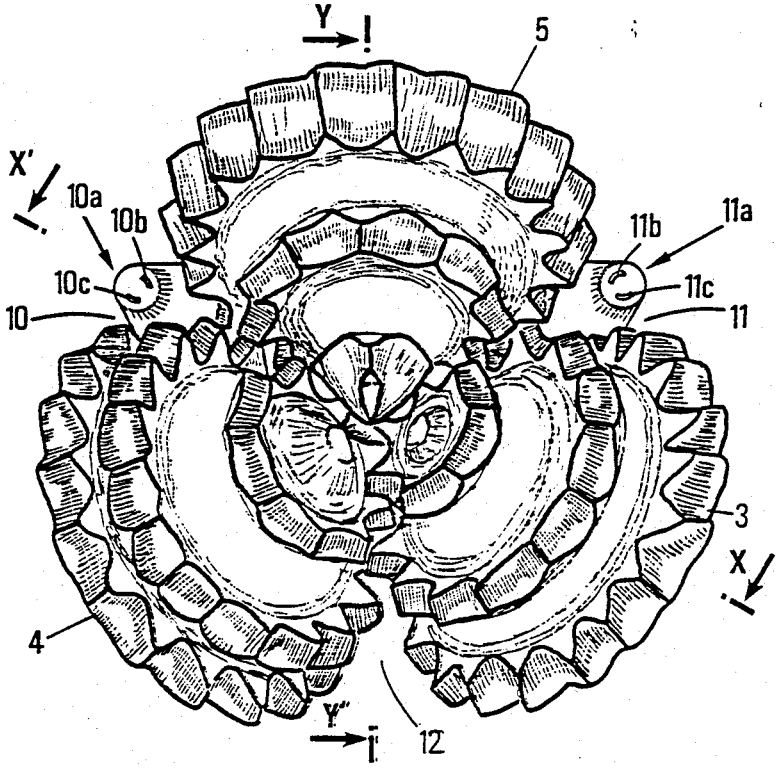
FIG. 1 is a bottom plan view of a drilling tool constructed in accordance with the present invention.
Figure 3:
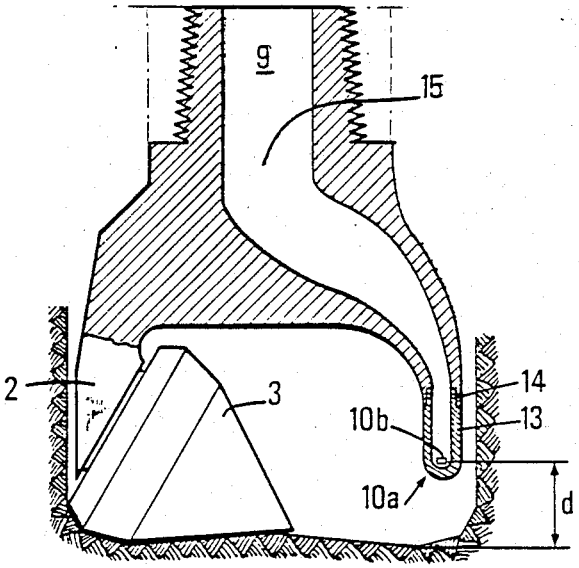
FIG. 3 is a cross-sectional view taken along line X'X in FIG. 1.
Figure 2:
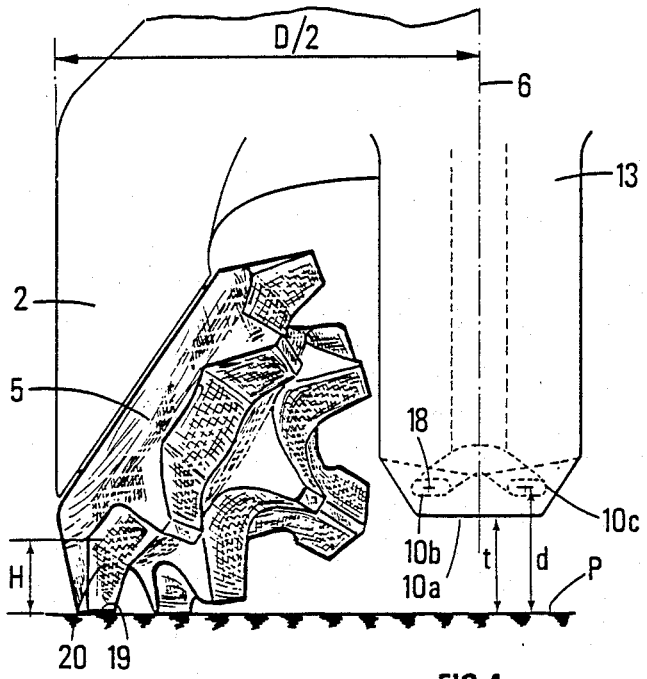
FIG. 2 is a partially schematic cross-sectional view illustrating magnitudes important for obtaining good performance of the drilling tool.

Referring now to the drawings wherein like reference numerals are used throughout the various views to designated like parts and, more particularly, to FIGS. 2 and 3, according to these figures, a drilling tool includes a tool body 1 fitted with three arms 2, only two of which are shown in the drawings, with the arms 2 having elements for biting into the ground composed of, for example, rollers or conical wheels 3, 4, 5 shown most clearly in FIG. 1. The roller or conical wheels 3, 4, 5 include axis which are inclined with respect to the tool axis 6 which corresponds to a direction of advance of the drilling tool. Each of the rollers or conical wheels 3, 4, 5 may be of a conventional construction and include teeth which, as shown in FIGS. 1 and 2, are capable of biting into the ground at the working face of the tool, with the teeth having a Height.

Figure 4:
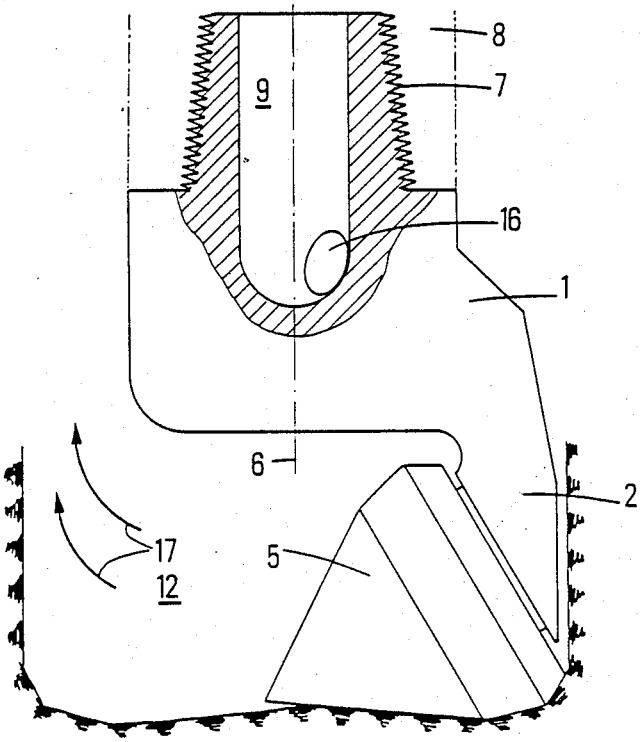
FIG. 4 is a cross-sectional view taken along line Y'Y in FIG. 1.

As shown in FIGS. 3 and 4, the tool body has an upper part 7 threaded so as to enable a connection of the drilling tool to a tool holder 8 (FIG. 4) which rotatably drives the tool. The tool holder 8 may be constituted by a drilling string in the case of rotary drilling, with a cavity 9, provided in the tool body 1, communicating directly with an internal channel of the drilling string. When the tool is directly rotatably driven by an underground motor (not shown) the tool holder 8 forms a rotor of the motor.

The tool body 1 is provided with nozzles generally designated by the reference numerals 10*a* and 11*a* which have calibrated orifices 10*b*, 10*c*, 11*b*, and 11*c* which communicate with cavity 9 via passages 15 and 16. Nozzles 10*a* and 11*a* are placed in two free spaces 10 and 11 between the rollers or conical wheels 3, 4, 5, preferably located essentially in the planes bisecting these spaces. Pairs of orifices 10*b*, 10*c* and 11*b*, 11*c* are placed in such a manner that, during tool operation, the fluid which feeds cavity 9 escapes through the orifices 10*b*, 10*c* and 11*b*, 11*c* forming two pairs of irrigation jets which flow in two free spaces 10 and 11 located respectively between the revolving rollers or conical wheels 4 and 5, and 3 and 5 and in a direction having a component directed in the direction in which the operating tool is advancing. A third free space 12 (FIGS. 1, 4) is provided between the revolving rollers or conical wheels 3 and 4, with no injection orifice being provided in the free space 12. Thus, a removal zone for the cutting-laden mud 17 is provided which enables a rapid evacuation of the mud 17. The cuttings are thus evacuated from the working face of the drilling tool as soon as they are created and, under these conditions, the drilling tool remains permanently clean, allowing for increased drilling speeds and increased service life of the tool elements such as, for example, the cutting teeth, bearings, etc.

As shown in FIG. 3, it may be advantageous for the fluid fed to the calibrated orifices 10*b*, 10*c* and 11*b*, 11*c* from the cavity 9 to come through pipes designed to minimize fluid pressure losses, particularly by a tangential connection to the wall of cavity 9.

In the embodiment shown in the drawings, the calibrated orifices 10*b*, 10*c* and 11*b*, 11*c* are composed of nozzle orifices 10*a* and 11*a*, respectively. The various orifices may be directed in such a manner that the jets of fluid that emerge from these orifices reach the revolving rollers or conical wheels 3, 4, 5 in the immediate vicinity of the working face of the drilling tool. In other words, the axis of the jets leaving the calibrated orifices may be essentially tangential to the revolving rollers or conical wheels 3, 4, 5. While the calibrated orifices 10*b*, 10*c*, and 11*b*, 11*c*, may be circular in configuration, preferably the orifices will have a slot-shape as shown most clearly in FIG. 2.

This being the case, to obtain maximum efficiency of the irrigation jets, each of the slot-shaped orifices is essentially parallel to a generatrix of the revolving rollers or conical wheels 3, 4, 5 on which the jet of fluid impinges, and arranged such that the jet acts on the greatest possible length of this generatrix.

Excellent results may be obtained by adhering to the following conditions:

$$\begin{cases} d \geqq 1.8\,H \text{ and} \\ 0.125\,D < d < 0.185\,D \end{cases}$$

and/or $$\begin{cases} t \geqq 1.5\,H \text{ and} \\ 0.1\,D < t < 0.15\,D \end{cases}$$

where:

d=a distance between a center 18 of an outlet orifice 10*b* of plane P perpendicular to the tool axis 6 and passing through the tips 19 of the teeth closest to the working face;

H=a of the teeth 20;

D=a diameter of the tool; and t=A minimum distance between the base of the nozzle or the extension and plane P.

Figure 5:
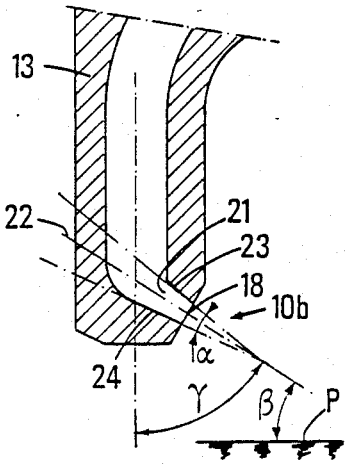
FIG. 5 is a partially schematic longitudinal cross-sectional view of a calibrated orifice constructed in accordance with the present invention with an upstream pipe.

As shown in FIG. 5, the calibrated orifice 10*b* is connected to a pipe 21 having a central axis 22 essentially corresponding to the jet axis, with the calibrated orifice 10*b* terminating at an edge 18. The walls of the pipe 21 define planes 23, 24, subtending an angle $\alpha$ of about 15°. An angle $\beta$ is defined between the central axis 22 of the pipe 21 and the plane P, with the angle $\beta$ being advantageously in a range of between 15° and 45°, and is preferably equal to about 30°.

When a nozzle has two calibrated orifices, the center axis of the orifices may advantageously form an angle of 120° between them. Of course, the nozzles may be interchangeably attached and will be selected by the user according to the flow rate and pressure of the irrigation fluid.

Modifications may be made without thereby departing from the scope of the present invention. For example, as shown in FIG. 3, the irrigation nozzles such as 10*a* may be mounted on an extension 13 attached to the tool body 1 by any known means, such as a feather key or thread 14, with the extension 13 forming an integral part of the tool body.

Figure 6:
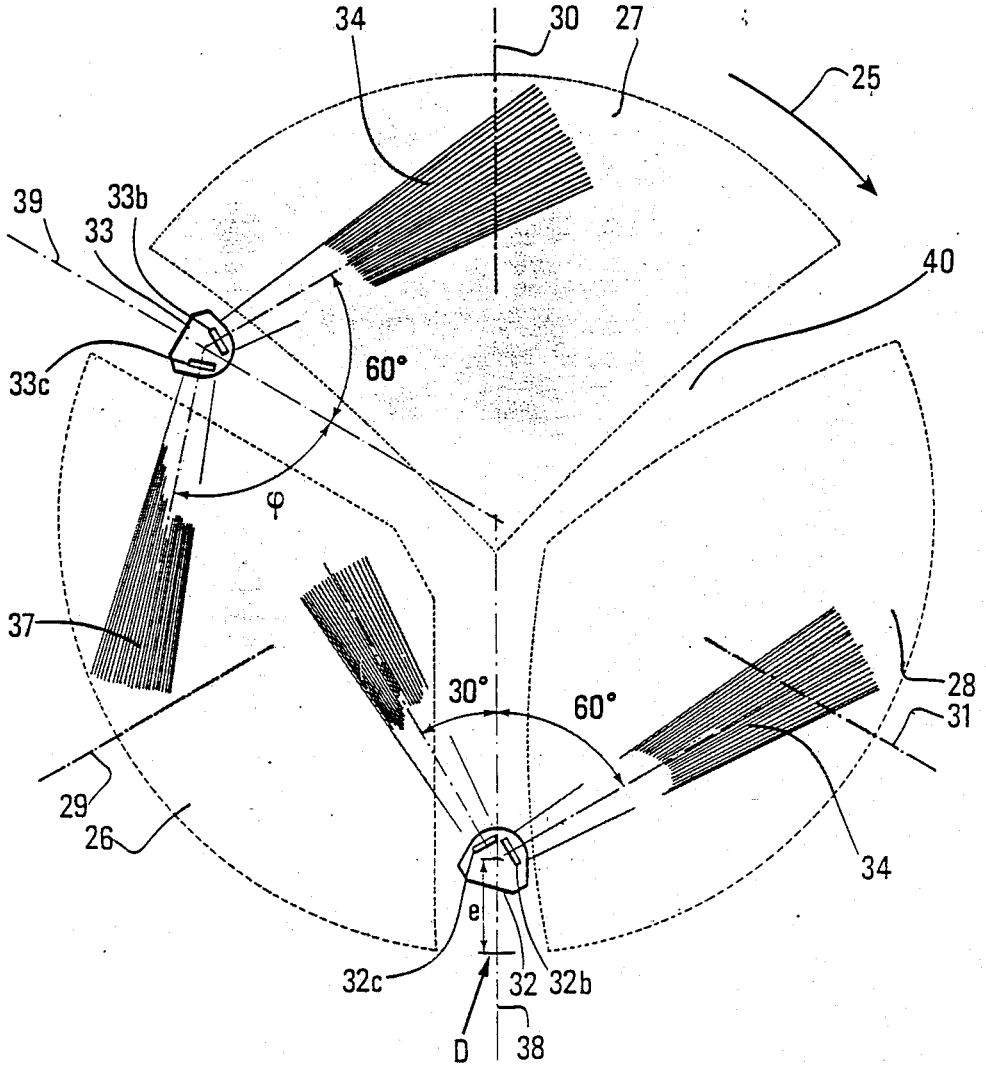
FIG. 6 is a schematic top view of an embodiment of the present invention particularly effective in removing cuttings from the drilling too.

In FIG. 6, a drilling tool particularly suitable for evacuation of cuttings includes three conical wheels 26, 27, 28 which respectively rotate about their axis 29, 30, 31. Nozzles 32, 33 are respectively disposed at opposite sides of the conical wheel 26, with the nozzles 32, 33 each having two oblong orifices 32*b*, 32*c*, and 33*b*, 33*c*.

Jets 34, 35, 36, and 37, produced by calibrated orifices 32*b*, 32*c*, 33*b*, and 33*c*, may be inclined at an angle $\eta$ of 60° (mean value with respect to the axis of the feed tube to the extension of the feed tube, which is parallel to the axis). Preferably, each jet may be tangential to the cone it sprays, in contact with the tool end of the rock.

In the embodiment of FIG. 6, the orientation of the jets at a plane normal to the tool axis at a level of the working face is obtained in the following manner. Each nozzle 32, 33 includes two orifices 32*b*, 33*b*, respectively, oriented at an angle of about 60° with respect to the median axis 38, 39, respectively, of the two conical wheels, 26, 28 and 26, 27, toward an intercone or free space 40 between the conical wheels 27 and 28, which space 40 has no orifice.

With respect to the other orifices 32*c* and 33*c* of each nozzle 32 and 33 respectively, for that orifice 32*c* located between the conical wheel 26 and 28, the orientation of the jet is at about 30° so as to clean the teeth of the conical wheel 26 located near the center of the tool. The angle of 30° should be considered with respect to the median axis 38 of conical wheels 26 and 28.

To effectively clean the outer diameter of the hole during drilling as well as the teeth, blades, or tips of the conical wheel 26, the calibrated orifice 33*c* located between the conical wheels 26 and 27 issues a jet the orientation of which is determined in accordance with the following relationship:

$$\tan\,[(\text{theta})]\,\eta = \frac{\sqrt{3}}{1 - \frac{4e}{D}},$$

where:

D=a diameter of the tool; and e=a distance separating a center of the calibrated orifice 33*c* from the tool circumference.

If the free space 40 between the conical wheels 27 and 28 is provided with a nozzle, the nozzle may be plugged or the location will be hollow and constructed so as to favor a proper return of the cuttings to the annular space. Additionally, the tool may be provided with a central nozzle (not shown), for insuring a thorough cleaning of the dome and center of the drilling tool.

Figure 7:
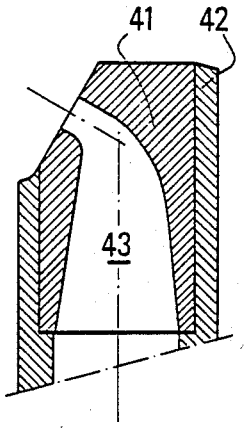
FIG. 7 is a partial longitudinal cross-sectional view of a modified nozzle constructed in accordance with the present invention.

FIG. 7 provides an example of a modified form of a nozzle 41, made of a carbide material, mounted inside an extension tube 42. An interior shape 43 of the nozzle 41 is, in a lower portion thereof, conical or forms a paraboloid of revolution so as to insure a perfect continuity of flow between the extension tube 42 and the nozzle 41.

Figure 9:
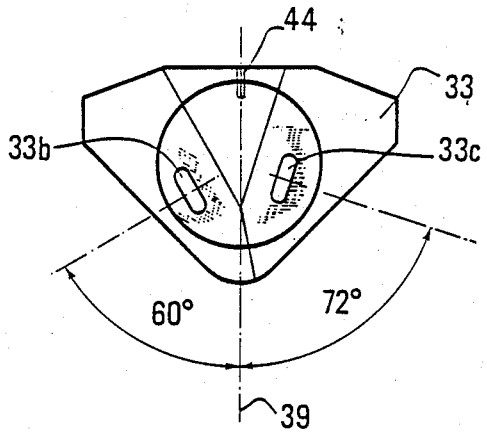
FIG. 9 is an end view of a still further embodiment of a nozzle constructed in accordance with the present invention.
Figure 8:
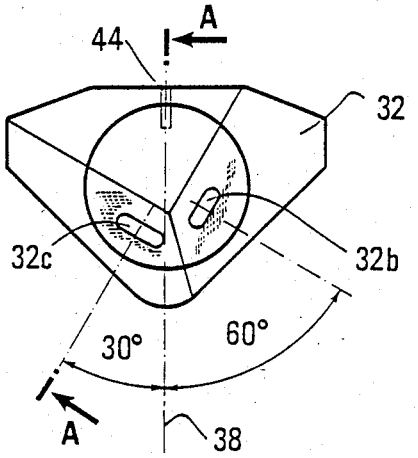
FIG. 8 is an end view of another embodiment of a nozzle constructed in accordance with the present invention.

In the embodiments of FIGS. 8 and 9, the nozzles 32 and 33 respectively define an angle $\eta$ of 72° with respect to the median axis 79. The nozzles 32, 33 may be fastened by suitable means (not shown) at a fastening point 44. The nozzles 32, 33 may be fastened in the extension tubes 42 by, for example, brazing thereby resulting in a non-recoverable or non-removable nozzle, or mechanically thereby enabling a removal of the respective nozzles.

Figure 10:
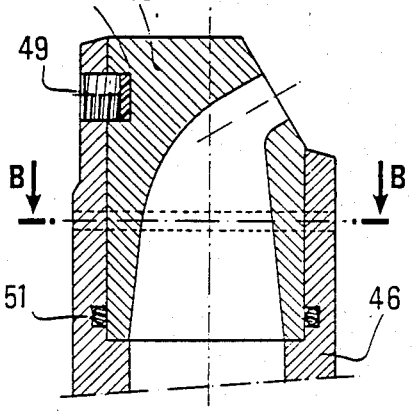
FIG. 10 is a partial longitudinal cross sectional view of a further modified nozzle construction in accordance with the present invention.

In FIG. 10, a removable nozzle 45 is provided with a seal between the nozzle 45 and the extension tube 46 being provided by an O-ring 51.

Figure 11:
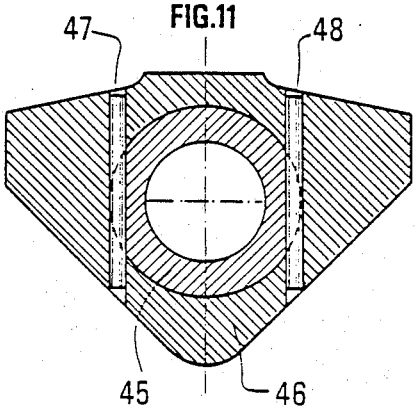
FIG. 11 is a cross-sectional view of a still further embodiment of a nozzle constructed in accordance with the present invention.

As shown in FIG. 11, two keys 47, 48 may be used for enabling the nozzle 45 to be fastened in a transversal position along the median axis or, as shown in FIG. 10, a locking screw 49 with a point may maintain the nozzle 45 in position and avoid any vibrational phenomena.

As shown in FIG. 10, the point of the locking screw 49 rests against a washer 50 made of, for example, neoprene or other elastomer, to provide a breaking function, unscrewing, and flow of the elastomer after tightening, causing the point of the locking screw 49 to engage the recess provided in the nozzle 45.

Two keys 47 and 48 (FIG. 11) allow the bean to be fastened in a transversal position along the median axis.

A locking screw 49 with a point may keep it in position and avoid any vibrational phenomena.

This screw with point rests against a washer 50 made of neoprene (or any other elastomer) to provide the functions of braking, unscrewing, and flow of the elastomer after tightening, causes the point to engage the recess in the bean.

We claim:

1. A ground drilling tool comprising:

a tool body means rotationally driven by a tool holder means, a cavity means provided in the tool body means for receiving a pressurized fluid through the tool holder means, a plurality of revolving parts held by the tool body means and provided with teeth means along a working face of the drilling tool for biting into the ground, irrigation means for delivering at least one jet of irrigation fluid directed at the working face of the drilling tool, said irrigation means having at least one first calibrated orifice means in the tool body means communicating with the cavity means in the tool body means and terminating in a first space between two adjacent rotating parts, said calibrated orifice means being adapted to produce a jet of fluid directed at one of the two revolving parts between which said first space is defined, a center of said jet of fluid emerging from said calibrated orifice means being located at a distance d from a plane perpendicular to and axis of the drilling tool passing through tips of the teeth means considered from the working face side, and wherein a diameter of the tool, a height of the teeth means, and said distance d are determined in accordance with the following relationship:

$d > 1.8H$ and $0.125D < d < 0.185D$, where:

D=a diameter of the drilling tool; and

H=a height of the teeth means.

2. A drilling tool according to claim 1, wherein said irrigation means includes an extension means for supporting said calibrated orifice means, said extension means being disposed at a minimum distance t from said plane, and wherein the magnitude of the diameter of the drilling tool, height of the teeth means, and minimum distance are determined in accordance with the following relationships:

$t > 1.5H$ and $0.1D < T < 0.15D$.

3. A drilling tool according to one of claims 1 or 2, wherein said irrigation means includes at least two calibrated orifice means for producing jets of fluid directed respectively at the two revolving parts between which said first space is defined.

4. A drilling tool according to claim 1, wherein the irrigation means includes at least one irrigation nozzle means for supporting said at least one calibrated orifice means.

5. A drilling tool according to one of claims 1 or 2, wherein the jet of fluid produced by said at least one calibrated orifice means has an orientation substantially tangential to outer surfaces of said revolving parts.

6. A drilling tool according to one of claims 1 or 2, wherein the revolving parts have an essentially conical shape, and wherein said at least one calibrated orifice means includes slots extending essentially parallel to a generatrix of a revolving part.

7. A drilling tool according to one of claims 1 or 2, wherein three revolving parts are provided and define three spaces between two adjacent revolving parts, and wherein only two of said spaces are provided with calibrated orifice means.

8. A drilling tool according to one of claims 1 or 2, wherein three revolving parts are provided and define three spaces between two adjacent revolving parts, and wherein one of said spaces is not provided with an injection orifice means.

9. A drilling tool according to one of claims 1 or 2, wherein said at least one calibrated orifice means is supported by a nozzle means, and wherein an axis of the jet of fluid produced by said calibrated orifice means forms an angle of between 15° and 45° with said plane.

10. A drilling tool according to claim 9, wherein said at least one calibrated orifice means has a slot shape including two walls defining an internal shape of said slot lying in two planes subtending an angle of approximately 15°.

11. A drilling tool according to claim 2, wherein two calibrated orifice means are provided and are disposed on respective sides of a plane substantially parallel to the tool axis containing essentially the axis of rotation of a revolving part, said at least two calibrated orifice means produce one jet of fluid each oriented toward said revolving part and directed toward the working face of the drilling tool, and said at least two calibrated orifice means are adapted to produce the jets of fluid offset with respect to each other.

12. A drilling tool according to claim 11, wherein a second space is defined between one of the two revolving parts and another adjacent revolving part, two other calibrated orifice means are disposed in said second space, each of said other calibrated orifice means being adapted to produce a jet directed toward the working face of the drilling tool and toward at least one of said revolving parts.

13. A drilling tool according to claim 12, wherein each of said jet of fluids produced by said other calibrated orifice means is oriented substantially at 60° with respect to a plane defined by the two revolving parts nearest to said calibrated orifice means.

14. A drilling tool according to claim 11, wherein one of said offset jets of fluid forms an angle of approximately 30° with respect to a plane defined by the two revolving parts nearest to said calibrated orifice means.

15. A drilling tool according to claim 14, wherein the other offset jet of fluid forms an angle $\eta$ approximately defined by the following relationships:

$$\tan[(\text{theta})]\ \eta = \frac{\sqrt{3}}{1 - \frac{4e}{D}}$$

where:

D=the diameter of the drilling tool; and e=the distance separating a center of said calibrated orifice means from a circumference of the drilling tool.

16. A drilling tool according to claim 9, wherein said angle is equal to 30°.

17. A ground drilling tool comprising:

a tool body means rotationally driven by a tool holder means, a cavity means provided in the tool body means for receiving a pressurized fluid through the tool holder means, a plurality of revolving parts held by the tool body means and provided with teeth means along a working face of the drilling tool for biting into the ground, irrigation means for delivering a jet of irrigation fluid directed at a working face of the drilling tool, said irrigation means comprising at least two calibrated orifice means in the tool body means communicating with the cavity means in the tool body means and terminating in a first space between two adjacent rotating parts, said two calibrated orifice means being disposed on respective sides of a plane substantially parallel to the tool axis containing essentially the axis of rotation of a revolving part and being adapted to produce one jet of fluid each oriented toward said revolving part and directed toward the working face of the drilling tool, with the at least two calibrated orifice means being adapted to produce the jets of fluid offset with respect to each other, a center of the jets of fluid emerging from the respected calibrated orifice means being located at a distance d from a plane perpendicular to an axis of the drilling tool passing through tips of the teeth means considered from the working face side, and wherein a diameter of the tool, a height of the teeth means, and said distance d are determined in accordance with the following relationship:

$$d > 1.8H \text{ and}$$

$$0.125D < d < 0.185D,$$

where:

D=a diameter of the drilling tool; and

H=a height of the teeth means.

* * * * *